US009510098B2

(12) United States Patent
Bai et al.

(10) Patent No.: US 9,510,098 B2
(45) Date of Patent: Nov. 29, 2016

(54) METHOD FOR RECORDING AND RECONSTRUCTING THREE-DIMENSIONAL SOUND FIELD

(71) Applicant: National Tsing Hua University, Hsinchu (TW)

(72) Inventors: Mingsian R. Bai, Hsinchu (TW); Yi-Hsin Hua, Hsinchu (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 91 days.

(21) Appl. No.: 14/572,564

(22) Filed: Dec. 16, 2014

(65) Prior Publication Data

US 2016/0057539 A1 Feb. 25, 2016

(30) Foreign Application Priority Data

Aug. 20, 2014 (TW) ..... 103128563 A

(51) Int. Cl.

| | |
|---|---|
| ***H04R 5/00*** | (2006.01) |
| ***H04R 5/027*** | (2006.01) |
| ***H04S 7/00*** | (2006.01) |
| *H04R 5/02* | (2006.01) |

(52) U.S. Cl.

CPC ..... *H04R 5/027* (2013.01); *H04S 7/30* (2013.01); *H04R 5/02* (2013.01); *H04S 2400/15* (2013.01)

(58) Field of Classification Search

CPC ..... H04R 5/00; H04R 5/02; H04R 5/027; H04R 3/00; H04R 3/005; H04S 2400/01; H04S 2400/15

See application file for complete search history.

(56) References Cited

U.S. PATENT DOCUMENTS

2004/0001598 A1* 1/2004 Balan ..... G06K 9/0057 381/92
2005/0080616 A1* 4/2005 Leung ..... H04R 5/027 704/200.1
2005/0123149 A1* 6/2005 Elko ..... H04R 3/005 381/92
2011/0222694 A1* 9/2011 Del Galdo ..... H04S 3/02 381/17
2012/0076316 A1* 3/2012 Zhu ..... H04R 3/005 381/71.11
2013/0223658 A1* 8/2013 Betlehem ..... H04S 3/002 381/307
2013/0230187 A1* 9/2013 Kuech ..... H04R 3/005 381/92
2013/0287225 A1* 10/2013 Niwa ..... H04R 3/00 381/92
2014/0192999 A1* 7/2014 Sannino ..... G01S 3/8083 381/92
2014/0270245 A1* 9/2014 Elko ..... H04R 3/005 381/92
2014/0286493 A1* 9/2014 Kordon ..... H04R 3/005 381/26
2015/0055797 A1* 2/2015 Nguyen ..... H04R 3/005 381/92
2015/0304766 A1* 10/2015 Delikaris-Manias ..... G10L 21/0216 381/92

FOREIGN PATENT DOCUMENTS

CN 101001485 A 7/2007

* cited by examiner

*Primary Examiner* — Thang Tran

(74) *Attorney, Agent, or Firm* — Muncy, Geissler, Olds & Lowe, P.C.

(57) ABSTRACT

A method for recording and reconstructing a three-dimensional (3D) sound field, wherein a microphone array is established in a 3D sound field to track and locate sound sources in the 3D sound field and retrieve corresponding sound source signals. A plurality of control points is established inside an area where the 3D sound field is to be reconstructed. The control points are used to establish relational expressions of the sound source signals, the 3D sound field, a reconstructed sound field, and reconstructed sound source signals. The reconstructed sound source signals are obtained via solving the relational expressions and input into a speaker array arranged outside the area to establish the reconstructed sound field in the area. The present invention truly records the 3D sound field without using any extra transformation process and replays the reconstructed sound field with a larger sweet spot in higher fidelity.

5 Claims, 2 Drawing Sheets

METHOD FOR RECORDING AND RECONSTRUCTING THREE-DIMENSIONAL SOUND FIELD

FIELD OF THE INVENTION

The present invention relates to a sound recording and replaying technology, particularly to a method for recording and reconstructing a three-dimensional sound field.

BACKGROUND OF THE INVENTION

Sound communication is very important for information exchange and emotional expression. With the prosperous development of multimedia industry, various sound recording apparatuses, such as recording pens, recorders and recording rooms, are progressing to record the sound field as truly as possible. Simultaneously, various sound playing devices, such as household speakers, vehicular audio systems, theater surround audio systems, and earphones, are required to present higher and higher fidelity. Therefore, high-end sound field recording and replaying technology is always the target the related manufacturers are eager to achieve.

A Chinese patent publication No. CN101001485 disclosed a finite-sound source and multi-channel sound field system, which comprises a microphone array recording M-channel audio signals and detecting the characteristics of the sound field; an audio frequency collection subsystem transforming the moduli of audio signals in different channels, packaging the audio data, and labeling the channels and timings; a server processing the audio data of the microphones, separating and processing the sound sources, compressing and storing data, mixing the data of the sound sources and transforming the mixed data into the output data of N pieces of speakers according to the M-channel sound source information and the characteristics of the reconstructed sound field; an audio restoring subsystem arranging the data of different sound sources into multi-channel analog signals and synchronizing the multi-channel speakers; and a speaker array playing the N-channel audio signals. Thereby, the prior art separates and collects sound source signals, dynamically matches M and N in a weighted way, omnidirectionally and precisely reproduces the original sound field, reduces the distortion of sound field phases, and avoids the interference and other distortions in processing, amplifying and playing signals.

However, the abovementioned finite-sound source and multi-channel sound field system needs a particle filter to separate noise and interference and has to transform audio data in recording signals, which results in complicated processes. Further, the conventional technology needs to adjust the volumes of speakers in replaying signals, which makes it likely to lose fidelity and have a smaller sweet spot. Therefore, the conventional technology still has room to improve.

SUMMARY OF THE INVENTION

The primary objective of the present invention is to solve the problem that the conventional sound field recording and replaying systems have disadvantages of complicated processes and a smaller sweet spot and are likely to lose fidelity.

To achieve the abovementioned objective, the present invention provide a method for recording a three-dimensional (3D) sound field, which is used to record a 3D sound field including a plurality of sound sources, and which comprises Step 1: establishing a microphone array including a plurality of microphones in a 3D sound field, and letting the microphones receive sound waves emitted by sound sources and each having the characteristics of a plane wave;

Step 2: expressing the sound pressure detected by the microphones with $$p(x_m,\omega)=s(\omega)e^{jk_m},m=1,2,\ldots,M, \quad \text{Equation (1):}$$

and $$p(\omega)=a(k)s(\omega), \quad \text{Equation (2):}$$

wherein $s(\omega)$ is a Fourier Transform of a sound source signal, $x_m$ the position of the mth microphone, k a wave-number vector, and wherein Equation (2) is a vector form of Equation (1), and wherein $a(k)=[e^{-jkx_1}\ldots e^{-jkx_M}]^T$ is a multi-element vector array;

Step 3: using a direction of arrival (DOA) algorithm to track and locate the sound source signals, and obtaining an orientation expression of the sound source signal;

Step 4: using the orientation expression, a Tikhonov regulation method and a convex optimization method to work out the sound source signal.

To achieve the abovementioned objective, the present invention also proposes a method of using the sound source signal to reconstruct the 3D sound field in an area, which comprises Step A: establishing a plurality of control points inside the area, and establishing a speaker array including a plurality of speakers outside the area;

Step B: using a plurality of sound waves each having the characteristics of a plane wave to form the 3D sound field, and expressing the relationship of the 3D sound field and the control points with $$p=Bs_p \quad \text{Equation (A):}$$

$$B=[b_1\ldots b_p] \quad \text{Equation (B):}$$

$$b_p==[e^{-jk_p y_1}\ldots e^{-jk_p y_n}]^T \quad \text{Equation (C):}$$

wherein p is the 3D sound field, $s_p$ a frequency-domain intensity vector of the sound source signal, $b_p$ a multi-element vector array of the pth sound wave to the control points, $y_n$ a position vector of the nth control point, B an aggregate matrix of all the multi-element vector arrays;

Step C: expressing a reconstructed sound field with $$\hat{p}=Hs_s \quad \text{Equation (D):}$$

wherein $s_s=[s_1(\omega)\ldots s_L(\omega)]^T$ is a frequency-domain intensity vector of a reconstructed sound source signal and H is a transfer function;

Step D: letting the reconstructed sound field approach the 3D sound field to obtain $$\min_{s_s}\|Bs_p-Hs_s\|\Rightarrow=s_s=H^+Bs_p, \quad \text{Equation (E):}$$

and inputting the obtained $s_s$ into the speaker array to reconstruct the sound field.

Via the abovementioned technical scheme, the present invention has the following advantages:

1. The present invention uses the DOA algorithm in recording the sound field to track the sound sources and obtain the number and orientation of the sound sources and the separated sound sources, exempted from the complicated process of transforming the sound source signals.

2. The present invention establishes control points in the area in reconstructing the sound field and uses the control points and the characteristics of the sound field to work out the reconstructed sound field, exempted from building a speaker array identical to the original microphone array in shape and size, and greatly enlarging the width of the sweet spot.

3. The present invention truly records the orientations and signals of the sound sources in recording the sound field and involves the information in calculation in reconstructing the sound field. In replaying the sound field, the signal of each of the speakers has been ready. Therefore, it is unnecessary to adjust the volumes of the speakers. Thus, the present invention is exempted from the distortion of the reconstructed sound field, which is caused by adjusting the speakers.

DETAILED DESCRIPTION OF THE PREFERRED EMBODIMENTS

The technical contents of the present invention will be described in detail in cooperation with drawings below.

Figure 1:
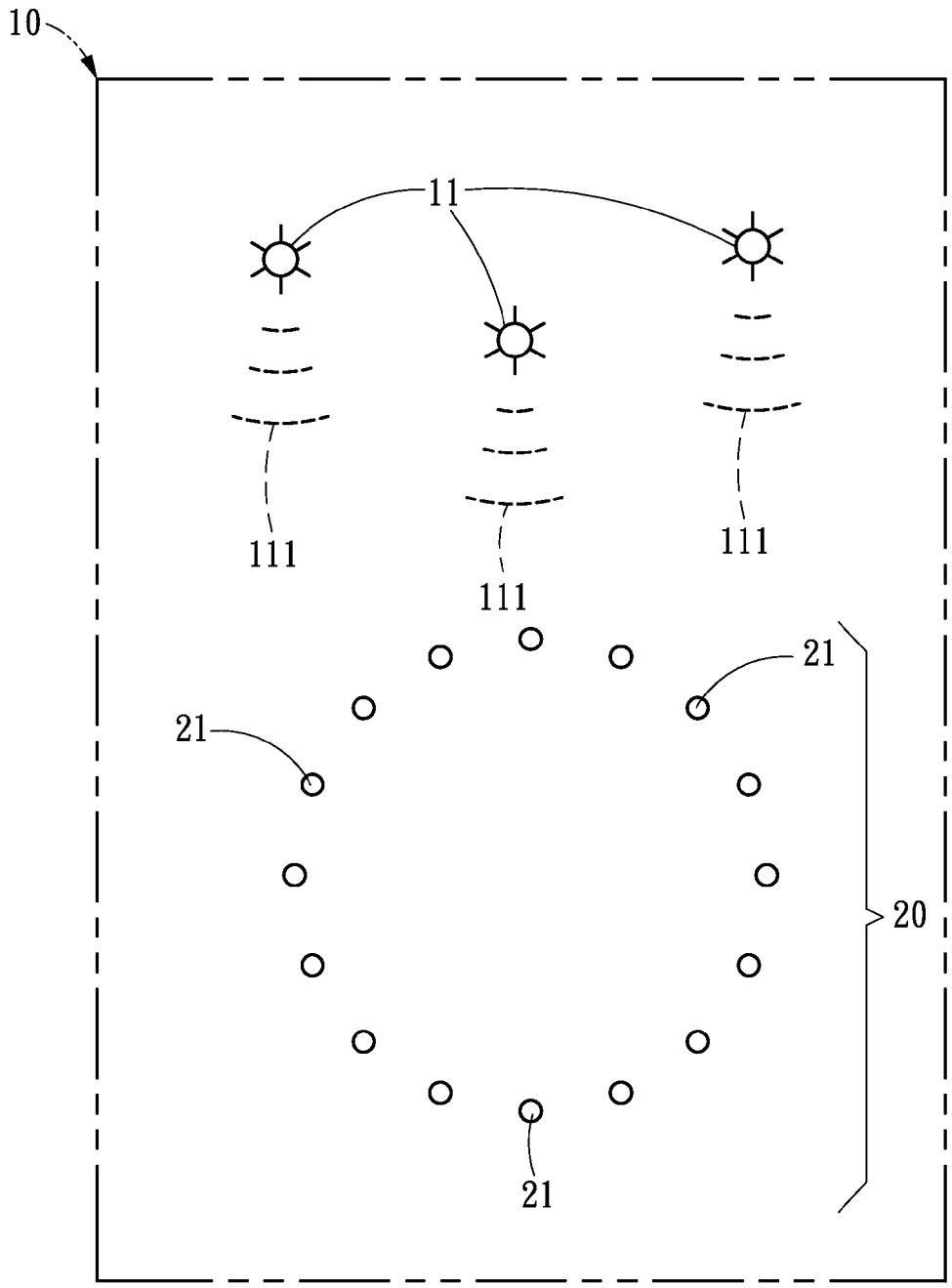
FIG. 1 is a diagram schematically showing a method for recording a three-dimensional (3D) sound field according to one embodiment of the present invention.

Refer to FIG. 1 a diagram schematically showing a method for recording a three-dimensional (3D) sound field according to one embodiment of the present invention. The recording method of the present invention is used to record a 3D sound field 10 including a plurality of sound sources 11. The method for recording a 3D sound field of the present invention comprises Steps 1-4.

In Step 1, establish a microphone array 20 including a plurality of microphones 21 in the 3D sound field 10, and let each microphone 21 receive sound waves 111 emitted by the sound sources 11 and each having the characteristics of a plane wave. In the embodiment shown in FIG. 1, the microphones 21 are arranged to have a circle shape. However, the present invention does not limit that the microphones must be arranged into a circle. In the present invention, the microphones may be arranged into other shapes.

In Step 2, express the sound pressure of the sound wave 111, which is detected by each microphone 21, with $$p(x_m,\omega)=s(\omega)e^{jk_m},m=1,2,\ldots,M, \quad \text{Equation (1):}$$

and $$p(\omega)=a(k)s(\omega), \quad \text{Equation (2):}$$

wherein $s(\omega)$ is a Fourier Transform of a sound source signal, $x_m$ the position of the mth microphone 21, k a wave-number vector, and wherein Equation (2) is a vector form of Equation (1), and wherein $a(k)=[e^{-jkx_1}\ldots e^{-jkx_M}]^T$ is a multi-element vector array.

In Step 3, use a direction of arrival (DOA) algorithm to track and locate the sound source signals, and obtain an orientation expression of the sound source signal. The DOA algorithm is a multiple signal classification method or a minimum variance distortionless response method. This embodiment of the present invention adopts the multiple signal classification method and obtains the orientation expressions:

$$S_{MUSIC}(\theta)=\frac{1}{a(\theta)^H P_N a(\theta)} \quad \text{Equation (3)}$$

$$\theta_g=\operatorname{argmax}_\theta S_{MUSIC}(\theta) \quad \text{Equation (4)}$$

wherein $S_{Music}(\theta)$ is the frequency spectrum of the multiple signal classification method, $\theta_S$ the rotation angle, and $P_N$ the matrix of the vectors projected to the noise subspace.

In Step 4, use the orientation expressions, a Tikhonov regulation method and a convex optimization method to work out the sound source signal. In this embodiment, Step 4 further includes Steps 4A-4C.

In Step 4A, let the 3D sound field 10 have N pieces of sound source signals, and undertake an inverse computation of Equation (2) to obtain $$s_p=A^+p \quad \text{Equation (5):}$$

wherein $s_p=[s_1(\omega)\ldots s_N]^T$ is the solution of the inverse computation of Equation (2) and $A=[a_1\ldots a_N]^T$ is the multi-element set of the N pieces of estimated orientations of the sound source signals.

In Step 4B, let N be smaller than M and let A be a singular matrix to solve an ill-conditioned problem; use the Tikhonov regulation method to obtain $$\min\|As_p-p\|^2+\beta\|s_p\|^2 \quad \text{Equation (6):}$$

and $$\hat{s}_p=(A^HA+\beta I)^{-1}A^Hp \quad \text{Equation (7):}$$

wherein β is a regulation parameter and $\hat{s}_p$ is the retrieved sound signal.

In Step 4C, regard the microphone array 20 as a sensing standard and regard the multi-element vector array as an expressing standard, and use a compressive sensing method to simply Equations (6) and (7) and obtain $$\min_\delta\|\hat{s}\|_1 st.\|Q\hat{s}-p\|_2\le\delta \quad \text{Equation (8):}$$

wherein δ is the boundary value of the constant and $Q=[a_1\ldots a_N]$ is the matrix of the DOA algorithm. Then, use the convex optimization method to form a convex optimization form. Then, work out the sound signal S and record the 3D sound field.

Figure 2:
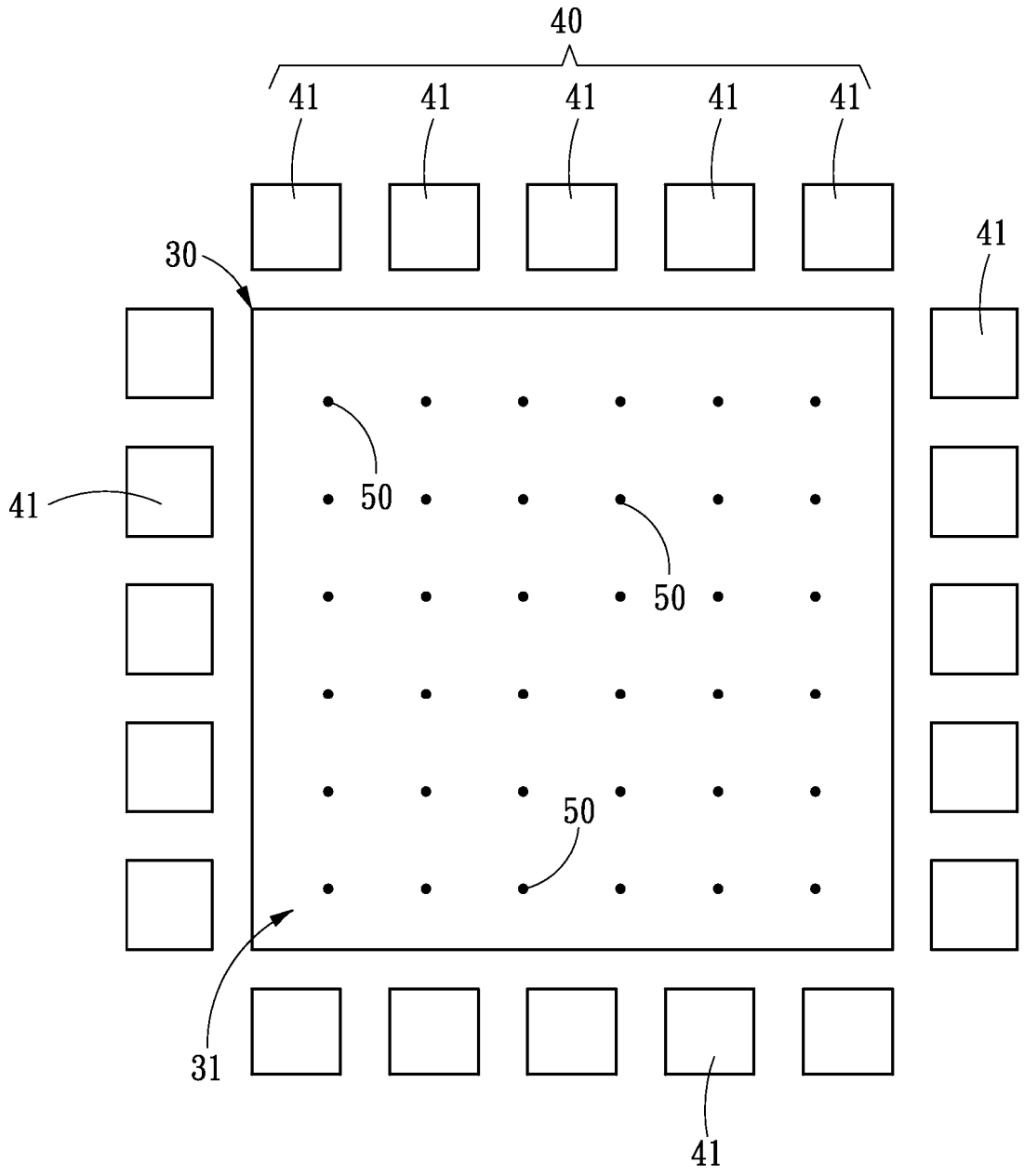
FIG. 2 is a diagram schematically showing a method for reconstructing a 3D sound field according to one embodiment of the present invention.

Refer to FIG. 2 a diagram schematically showing a method for reconstructing a 3D sound field according to one embodiment of the present invention. The present invention further proposes a method of using a sound source signal to reconstruct a 3D sound field. The sound source signal is recorded in the 3D sound field 10 and used to establish a reconstructed sound field 31 in an area 30. The reconstructing method of the present invention comprises Steps A-D.

In Step A, establish a plurality of control points 50 inside the area 30, and establish a speaker array 40 including a plurality of speakers 41 outside the area 30.

The control points 50 inside the area 30 respectively have their own orientations.

The speakers 41 are selectively arranged in the surrounding of the area 30.

In Step B, form the 3D sound field 10 with a plurality of sound waves 111 each having the characteristics of a plane wave, and express the relationship between the 3D sound field 10 and the control points 50 with $$p=Bs_p \quad \text{Equation (A):}$$

$$B=[b_1 \ldots b_p] \quad \text{Equation (B):}$$

$$b_p=[e^{-jk_p y_1} \ldots e^{-jk_p y_n}]^T \quad \text{Equation (C):}$$

wherein p is the 3D sound field 10, $s_p$ the frequency-domain intensity vector of the sound source signal, $b_p$ the multi-element vector array of the pth sound wave 111 to the control points 50, $y_n$ the position vector of the nth control point 50, B the aggregate matrix of all the multi-element vector arrays.

In Step C, express the reconstructed sound field 31 with $$\hat{p}=Hs_s \quad \text{Equation (D):}$$

wherein $s_s=[s_1(\omega) \ldots s_L(\omega)]^T$ is the frequency-domain intensity vector of the reconstructed sound field 32, i.e. the signal for the speaker 42; H is the transfer function. The signal for the speaker 42 may be regarded as a point sound source whose sound wave has the characteristic of a spherical wave. Therefore, the signal for the speaker 42 may be expressed by a Green's function $$\{H\}_{nl} = \frac{e^{-jkr_{nl}}}{r_{nl}}, \quad r_{nl} = \|y_n - y_l\|, \quad \text{Equation (D1)}$$

wherein $\{H\}_{nl}$ is a Green's function, and r, the distance from each control point to each speaker.

In Step D, let the reconstructed sound field 31 approach the 3D sound field 10, and undertake an inverse computation to obtain $$\min_{s_s}\|Bs_p-Hs_s\| \Rightarrow s_s=H^+Bs_p \quad \text{Equation (E):}$$

wherein $H^+$ is the pseudo-inverse matrix of H. The solution can be obtained with a truncated singular value decomposition method. Then, the acquired signal $s_s$ of each speaker is input into the speaker array 40 to establish the reconstructed sound field 31.

In conclusion, the present invention proposes a method for recording a 3D sound field and a method of using a sound source signal to reconstruct a 3D sound field and uses them to combine a microphone array and a speaker array to form an integrated array able to record and replay a 3D sound field. The present invention at least has the following advantages:

1. The present invention can directly obtain the number and orientations of the sound sources and the separated sound sources, exempted from the complicated process of transforming the sound source signals.
2. The present invention needn't build a speaker array identical to the original microphone array in shape and size and greatly enlarges the width of the sweet spot.
3. In replaying, the signal for each of the speakers has been ready. Therefore, it is unnecessary to adjust the volumes of the speakers. Thus, the present invention is exempted from the distortion of the reconstructed sound field, which is caused by adjusting the speakers.
4. The present invention can present an identical 3D sound field in different areas and make the listeners seem to be situated in the original 3D sound field.

Therefore, the present invention possesses utility, novelty and non-obviousness and meets the condition for a patent. Thus, the Inventors file the application for a patent. It is appreciated if the patent is approved fast.

The present invention has been described in detail with the abovementioned embodiments. However, these embodiments are only to exemplify the present invention but not to limit the scope of the present invention. Any equivalent modification or variation according to the spirit of the present invention is to be also included within the scope of the present invention.

What is claimed is:

1. A method for recording a three-dimensional (3D) sound field, used to record a 3D sound field including a plurality of sound sources, and comprising Step 1: establishing a microphone array including a plurality of microphones in a 3D sound field, and receiving and recording with each microphone sound waves emitted by the sound sources and each sound wave having characteristics of a plane wave;

Step 2: calculating a sound pressure of each sound wave detected by each microphone in Step 1, with $$p(x_m,\omega)=s(\omega)e^{-jkx_m}, m=1,2, \ldots ,M, \text{ and} \quad \text{Equation (1):}$$

$$p(\omega)=a(k)s(\omega), \quad \text{Equation (2):}$$

wherein $s(\omega)$ is a Fourier Transform of a sound source signal, $x_m$ is a position of an mth microphone, and k is a wave-number vector, j is an integer, k is an integer, m is an integer, ω is an angle, and wherein Equation (2) is a vector form of Equation (1), wherein $a(k)=[e^{-jkx_1} \ldots e^{-jkx_M}]^T$ is a multi-element vector array, wherein $p(x_m,\omega)$ represents the sound pressure detected at each position ($x_m$) of the microphone array, and wherein p (ω) represents the sound pressure detected by the microphone array;

Step 3: applying a direction of arrival (DOA) algorithm to the sound pressure of each microphone to locate sound source signals of the sound waves calculated in Step 2, and obtaining an orientation expression of each sound source signal; and Step 4: using the orientation expression, a Tikhonov regularizing method and convex optimization to identify the sound source signal.

2. The method for recording a 3D sound field according to claim 1, wherein in Step 3, the DOA algorithm includes a multiple signal classification locating method, and wherein the multiple signal classification locating method is used to obtain the orientation expressions of each sound source signal:

$$S_{MUSIC}(\theta) = \frac{1}{a(\theta)^H P_N a(\theta)}, \text{ and} \quad \text{Equation (3)}$$

$$\theta_g = \text{argmax}_\theta S_{MUSIC}(\theta), \quad \text{Equation (4)}$$

wherein $S_{MUSIC}$ (θ) is a frequency spectrum of the multiple signal classification locating method, $\theta_S$ is a rotation angle, a (θ) is a vector continuum, H is a transfer function, and $P_N$ is a matrix of the vectors projected to a noise subspace, such that the rotation angle of each sound source signal is determined as the orientation expression.

3. The method for recording a 3D sound field according to claim 2, wherein Step 4 includes:

Step 4A: calculating the 3D sound field comprising N pieces of sound source signals, and calculating an inverse of Equation (2) as $S_p$, and then using Equation (5) below to calculate the N pieces of sound source signals:

$$s_p = A^+ p, \quad \text{Equation (5):}$$

wherein $s_p = [s_1(\omega) \ldots s_N(\omega)]^T$ is a solution of the inverse of Equation (2), N is an integer, and $A = [a_1 \ldots a_N]^T$ is a multi-element set of N pieces of estimated orientations of the sound source signals;

Step 4B: linearizing Sp with the Tikhonov regularizing method as follows, where N is smaller than M:

$$\min \|As_p - p\|^2 + \beta \|s_p\|^2, \text{ and} \quad \text{Equation (6):}$$

$$\hat{s}_p (A^H A + \beta I)^{-1} A^H p, \quad \text{Equation (7):}$$

wherein β is a regression parameter and $\hat{s}_p$ is a retrieved sound signal;

Step 4C: using a compressive sampling method to simplify Equations (6) and (7) as Equation (8):

$$\min_{\hat{s}} \|\hat{s}\|_1 st. \|Q\hat{s} - p\|_2 \leq \delta \quad \text{Equation (8):}$$

wherein δ is a boundary value of a constant, and $Q = [a_1 \ldots a_N]$ is a matrix of the DOA algorithm, and applying the convex optimization to generate and record the sound source signal of each of the sound sources, wherein the sound source signal is expressed by $\hat{s}$.

4. A method to reconstruct the 3D sound field using the sound signals in claim 1, comprising:

Step A: establishing a plurality of control points inside an area, and establishing a speaker array including a plurality of speakers outside the area;

Step B: forming the 3D sound field as a relationship between the 3D sound field and the control points with Equations (A), (B), and (C) defining the relationship:

$$p = Bf_p, \quad \text{Equation (A):}$$

$$B = [b_1 \ldots b_p], \text{ and} \quad \text{Equation (B):}$$

$$b_p = [e^{-jk_p y_1} \ldots e^{-jk_p y_n}]^T \quad \text{Equation (C):}$$

wherein p is the 3D sound field, $f_p$ a frequency-domain intensity vector of the sound source signals, $b_p$ a multi-element vector array of the pth sound wave to the control points, $y_n$ the position vector of the nth control point, B the aggregate matrix of all the multi-element vector arrays;

Step C: reconstructing the 3D sound field $\hat{P}$ as $$\hat{p} = H_{s_s}, \quad \text{Equation (D):}$$

wherein $s_s = [s_1(\omega) \ldots s_L(\omega))]^T$ is a frequency-domain intensity vector of a reconstructed sound field, and H is a transfer function; and Step D: bounding the reconstructed sound field to approach the 3D sound field as in Equation (E) to generate a reconstructed 3D sound field, $$\min_{s_s} \|Bs_p - Hs_s\| \Rightarrow s_s = H^+ Bs_p \quad \text{Equation (E):}$$

and inputting the frequency-domain intensity vector $s_s$ into the speaker array to output the reconstructed 3D sound field.

5. The method to reconstruct the 3D sound field according to claim 4, wherein in Step D, a final $s_s$ is obtained with a truncated singular value decomposition method.

* * * * *